US012433389B2

(12) United States Patent
Reynolds

(10) Patent No.: US 12,433,389 B2
(45) Date of Patent: Oct. 7, 2025

(54) MAGNETIC BACKPACK HANDLE DEVICE

(71) Applicants: Seung Joo Yang, Rhodes (AU); Luke Milton Reynolds, Paddington (AU)

(72) Inventor: Luke Milton Reynolds, Brisbane (AU)

( * ) Notice: Subject to any disclaimer, the term of this patent is extended or adjusted under 35 U.S.C. 154(b) by 0 days.

(21) Appl. No.: 18/924,714

(22) Filed: Oct. 23, 2024

(65) Prior Publication Data

US 2025/0127283 A1 Apr. 24, 2025

Related U.S. Application Data

(60) Provisional application No. 63/592,468, filed on Oct. 23, 2023.

(51) Int. Cl.
*A45F 3/04* (2006.01)
*A45F 3/00* (2006.01)

(52) U.S. Cl.
CPC ..... *A45F 3/04* (2013.01); *A45F 2003/001* (2013.01)

(58) Field of Classification Search
CPC ..... A45F 3/04; A45F 2003/001
See application file for complete search history.

(56) References Cited

U.S. PATENT DOCUMENTS 3,076,679 A * 2/1963 Lorber ..... B60R 22/02 297/481
3,144,274 A * 8/1964 Norvin ..... B60R 22/02 24/303
4,504,000 A * 3/1985 Doyel ..... A45F 3/48 D3/25
4,925,070 A * 5/1990 Tulgan ..... A45F 3/04 224/901.2
6,224,537 B1 5/2001 Shin
7,806,309 B2 * 10/2010 Korchmar ..... A45F 3/14 224/183
8,251,269 B2 * 8/2012 Winneur ..... A45C 9/00 224/652
9,345,301 B2 * 5/2016 Brouard ..... A45C 13/36
(Continued)

FOREIGN PATENT DOCUMENTS

CN 213407543 U * 6/2021
KR 20210019021 A 2/2021
KR 20210041995 A 4/2021

OTHER PUBLICATIONS

Pack Hacker Team, Peak Design Everyday Backpack 30L (V2) Review, retrieved from Internet, posted on Dec. 12, 2019, <URL: https://packhacker.com/travel-gear/peak-design/everyday-backpack-30l-v2/>.

(Continued)

*Primary Examiner* — Scott T McNurlen

(57) ABSTRACT

A magnetic backpack handle device is a backpack handle with a plurality of magnets concealed within to conveniently stow the handle when not in use. In other words, the magnetic backpack handle seeks to provide users with a device that can stop a backpack handle from flopping around behind a user's head and neck area when wearing a backpack and without any magnets or other metal parts or housing installed into the materials which can be visible on the bag or handle. In order to accomplish this the device comprises a backpack handle that has a plurality of magnets embedded into handle and rear surface of the backpack. Thus, the plurality of backpack magnets secures the backpack handle to the backpack surface when not in use.

13 Claims, 7 Drawing Sheets

(56) References Cited

U.S. PATENT DOCUMENTS

| | | | | |
|---|---|---|---|---|
| 11,000,108 | B1 | 5/2021 | Jusic | |
| 2020/0170389 | A1 | 6/2020 | Uriarte | |
| 2020/0367627 | A1 | 11/2020 | McCarthy | |
| 2021/0068510 | A1 | 3/2021 | Johnson | |
| 2023/0309672 | A1 | 10/2023 | Tabor | |
| 2024/0335024 | A1* | 10/2024 | Lyu | A45F 3/12 |

OTHER PUBLICATIONS

Allbaugh, Lea Rose, Peak Design Travel Backpack Review—Is The Bag Worth It?, retrieved from Internet, posted on Apr. 8, 2024, <URL: https://travellemming.com/peak-design-travel-backpack-review/>.

* cited by examiner

MAGNETIC BACKPACK HANDLE DEVICE

The current application claims a priority to the U.S. provisional patent application Ser. No. 63/592,468 filed on Oct. 23, 2024.

FIELD OF THE INVENTION

The present invention relates generally to a magnetic backpack carrying handle device. More specifically, the present invention is the top handle of a backpack that is installed above the shoulder straps. The present invention is further a device that utilizes magnets that are constructed inside the materials of the backpack so that no metal parts are visible from the outside of the bag. This handle is designed to secure a backpack handle to the main body of a backpack.

BACKGROUND OF THE INVENTION

Backpack handles are an often overlooked yet essential component of these versatile bags. Found at the top of the backpack, these handles serve several crucial functions. Firstly, they provide a convenient means of carrying the backpack when not worn on the shoulders. Whether it's lifting the bag onto a luggage rack, carrying it through crowded spaces, or quickly grabbing it from a storage area, the handle offers a secure grip. Additionally, the handle is valuable for maintaining balance and stability when maneuvering the backpack, especially in situations where wearing it isn't practical. For example, travelers might use the handle to navigate busy airports, students may carry their backpacks when entering a classroom, or outdoor enthusiasts may lift their packs over challenging terrain.

Manufacturers pay attention to the design and durability of backpack handles to ensure they can withstand the weight and strain placed upon them. Reinforced stitching and sturdy materials are often used to enhance their strength. Some backpacks even feature padded or ergonomic handles for added comfort during prolonged carrying. While backpack handles might seem like a small detail, they significantly contribute to the bag's overall usability and convenience. They enable users to transport their belongings comfortably, securely, and efficiently, making them a vital component of these versatile and widely used bags. Unfortunately, many backpack handles simply hang down, interfere with comfortably wearing the backpack and interfere with easily accessing the compartments within a backpack.

An objective of the present invention is to provide users with a standard backpack handle with integrated magnets, to help secure a handle when not in use and without any metal or magnetic parts installed on the outside of the materials and/or being visible on the outside of the handle or backpack. The present invention intends to provide users with a device that can quickly and efficiently magnetically attach to the outside of a backpack surface. In order to accomplish that, a preferred embodiment of the present invention comprises a backpack handle and a plurality of backpack magnets. Further, the plurality of backpack magnets ensures that the backpack handle easily secures to the surface of any standard backpack. Thus, the present invention is a magnetic backpack handle that secures to the surface of any standard backpack with integrated magnets.

SUMMARY OF THE INVENTION

The present invention is a backpack handle with a plurality of magnets concealed within to conveniently stow the handle when not in use. The present invention seeks to provide users with a device that can stop a backpack handle from flopping around behind a user's head and neck area when wearing a backpack and without any magnets or other metal parts or housings installed into the materials which can be visible on the bag or handle. In order to accomplish this, a preferred embodiment of the present invention comprises a backpack handle and a plurality of backpack magnets. Further, the plurality of backpack magnets secures the backpack handle to the backpack surface when not in use. Thus, the present invention is a magnetic backpack handle that secures to the surface of any standard backpack with integrated magnets.

DETAILED DESCRIPTION OF THE INVENTION

All illustrations of the drawings are for the purpose of describing selected versions of the present invention and are not intended to limit the scope of the present invention.

In reference to FIG. 1 through FIG. 7, the present invention is a magnetic backpack handle 6.

Figure 1:
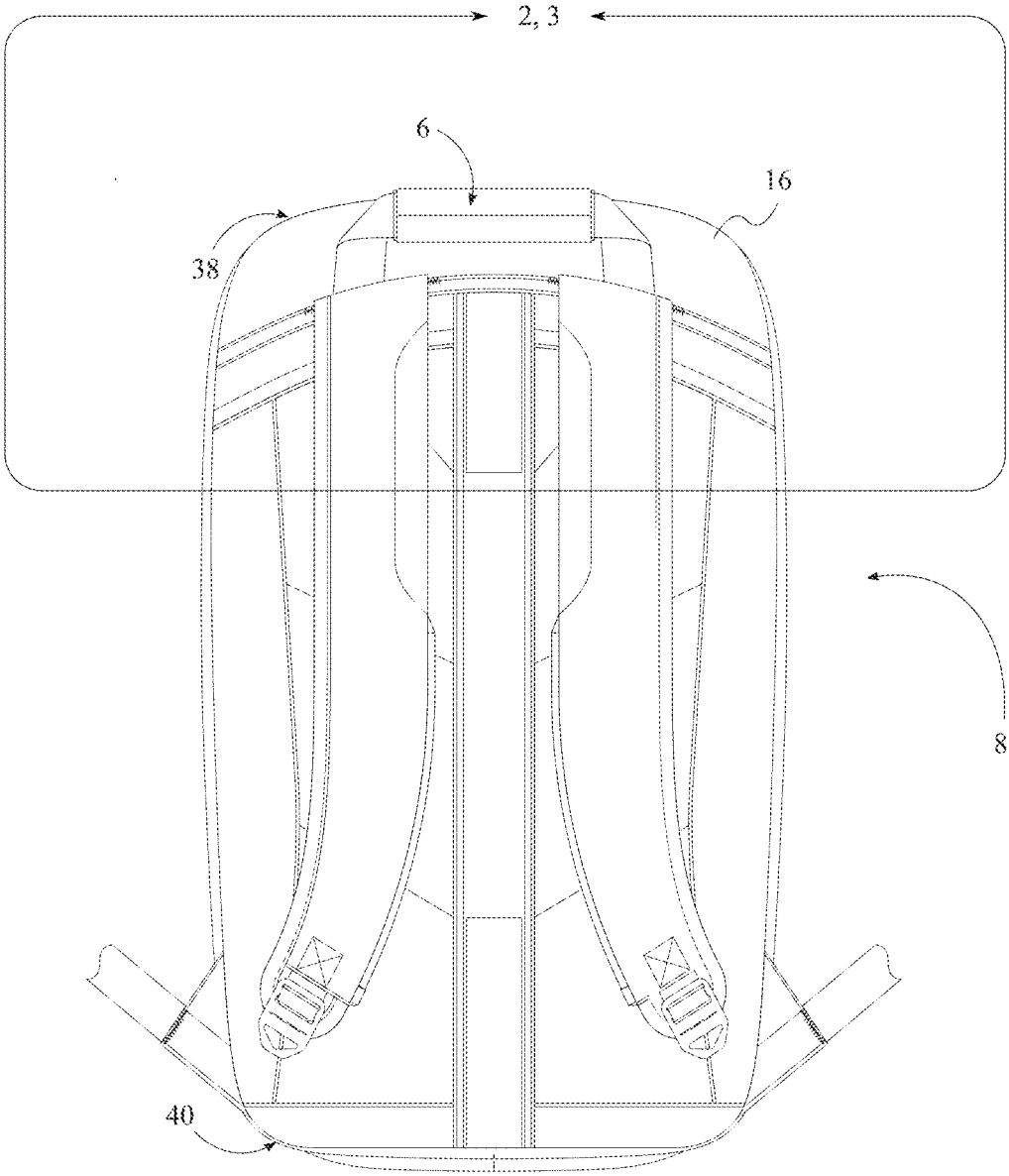
FIG. 1 is an illustration of a backpack according to a preferred embodiment of the present invention.
Figure 2:
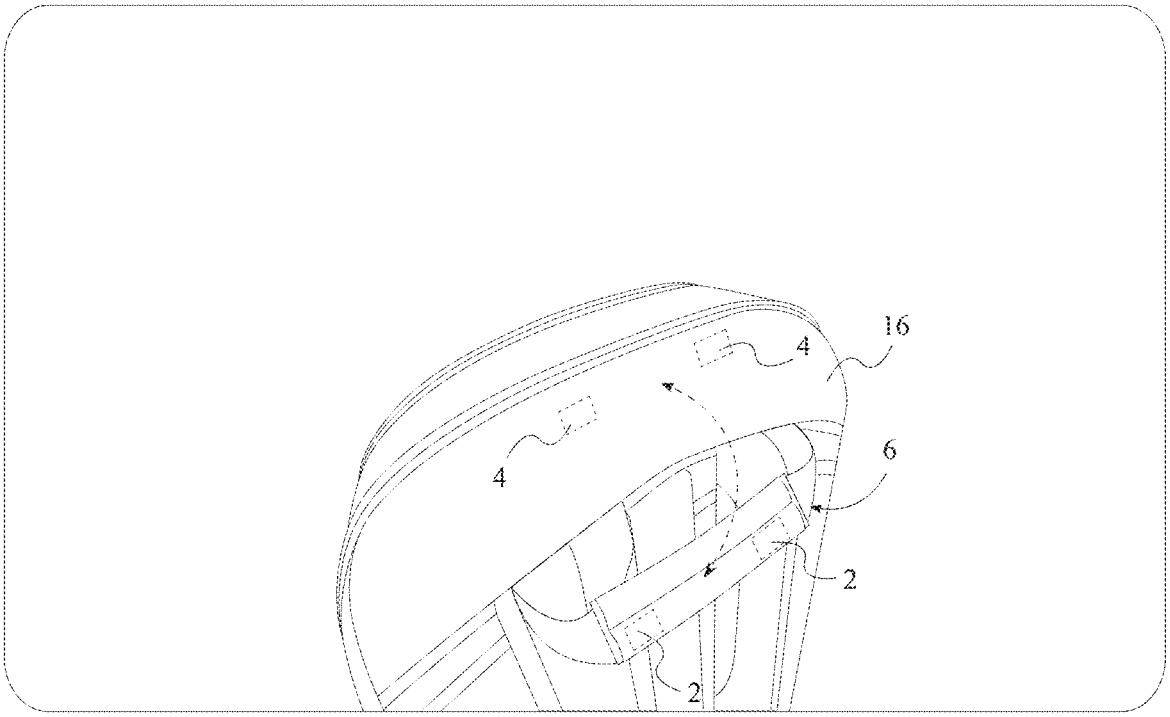
FIG. 2 is a detailed view of section 2 from FIG. 1, wherein the backpack handle is in a deployed configuration.
Figure 3:
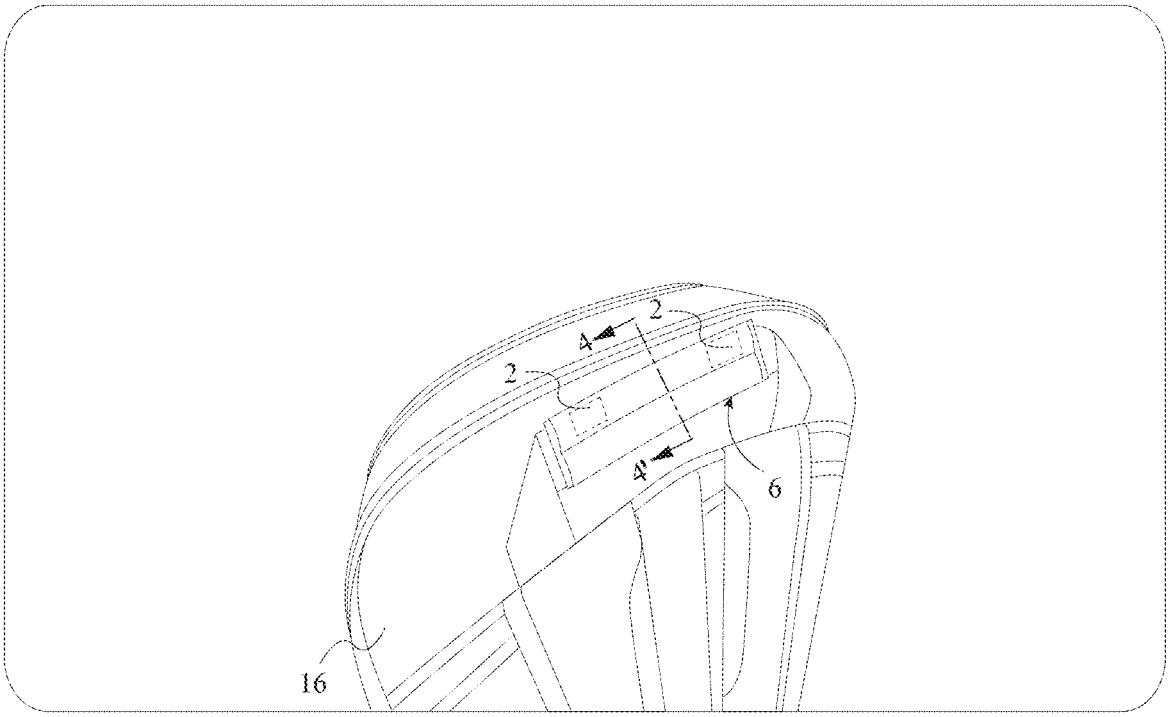
FIG. 3 is a detailed view of section 3 from FIG. 1, wherein the backpack handle is in a stowed configuration.

The following description is in reference to FIG. 1 through FIG. 7. According to a preferred embodiment, the present invention comprises at least one handle magnet 2, at least one backpack magnet 4, a backpack handle 6, and a backpack bag 8. As seen in FIG. 1, the backpack bag 8 comprises a proximal exterior surface 16. Preferably, the proximal exterior surface 16 is the rear surface with extra padding, adjacent to a pair of shoulder pads 41, that helps to embed a plurality of magnets onto the backpack surface. To that end, the at least one backpack magnet 4 is integrated into the backpack bag 8, adjacent to the proximal exterior surface 16. As seen in FIG. 2, the at least one handle magnet 2 is integrated into the backpack handle 6, and the backpack handle 6 is mounted adjacent to the proximal exterior surface 16 of the backpack bag 8. This is so that the at least one handle magnet 2 is operatively coupled to the at least one backpack magnet 4, wherein a position of the backpack handle 6 in relation to the proximal exterior surface 16 and a magnetic field of attraction between the at least one backpack magnet 4 and the at least one handle magnet 2 are used to transition the backpack handle 6 from a deployed configuration to a stowed configuration and vice versa. FIG. 2 represents the present invention in the deployed configuration and FIG. 3 illustrates the present invention in the stowed configuration. In other words, the plurality of integrated magnets ensures that the backpack handle 6 stays secured to a standard backpack surface and out of the way until needed by the user. Preferably, the at least one handle magnet 2 and the at least one backpack magnet 4 comprise a plurality of cylindrical Neodymium (N52) magnets. As seen in FIG. 2 and FIG. 3, the at least one handle magnet 2 and the at least one backpack magnet 4 are embedded within the backpack and are shown in broken lines. However, any other magnets with any other shape, size, components, arrangement of components, etc. may be used as the at least one backpack magnet 4 and the at least one handle magnet 2, as long as the intents of the present invention are not altered.

Figure 4:
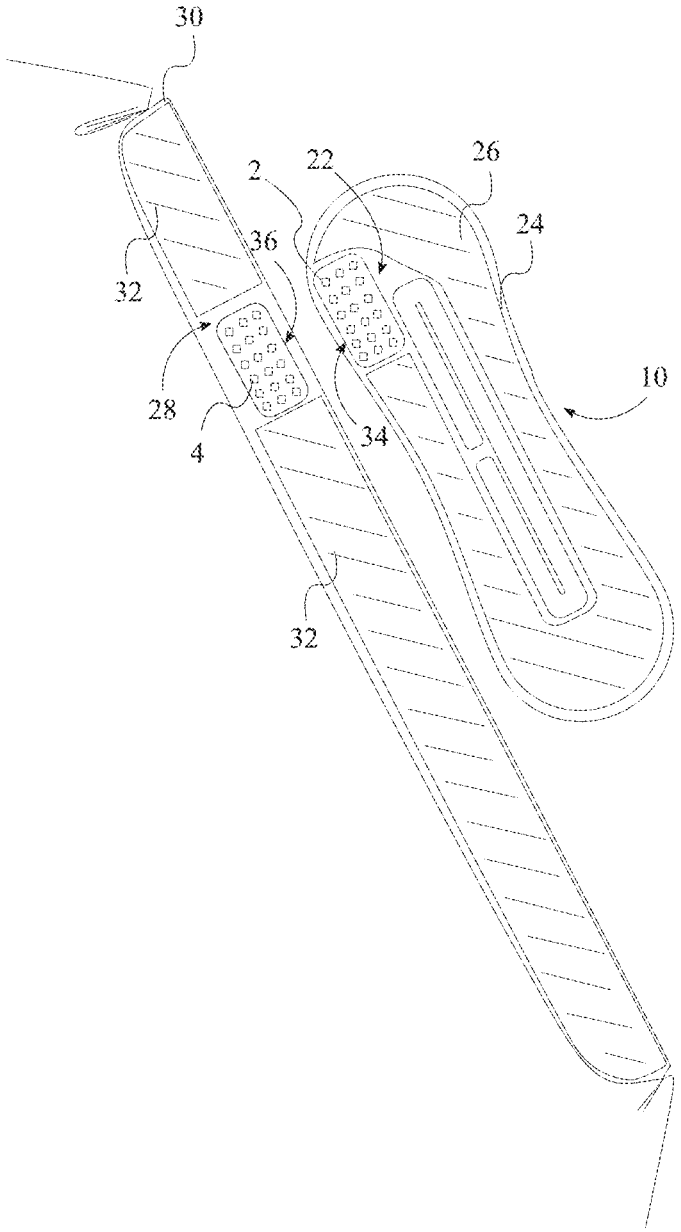
FIG. 4 is a cross-section view of the backpack handle and backpack surface taken along line 4-4 in FIG. 3.
Figure 5:
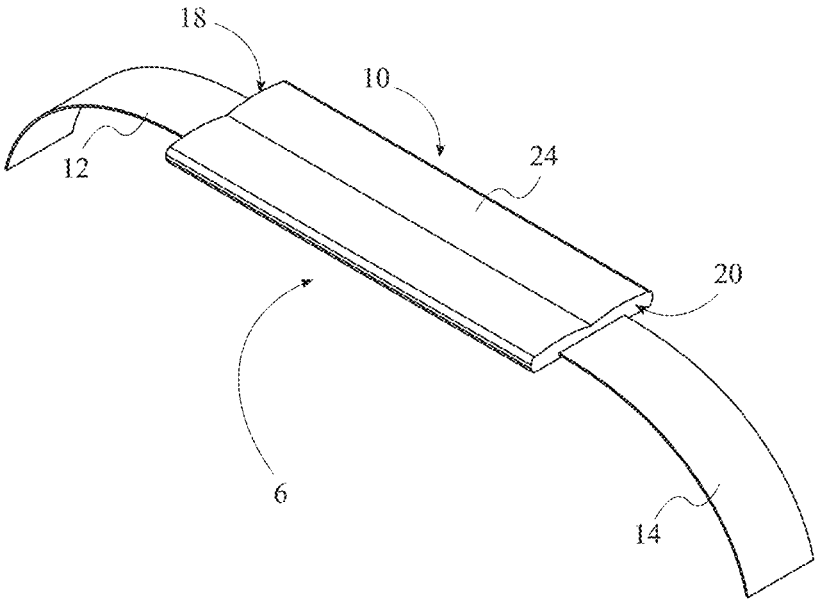
FIG. 5 is a perspective view of an exemplary embodiment for the present invention.
Figure 6:
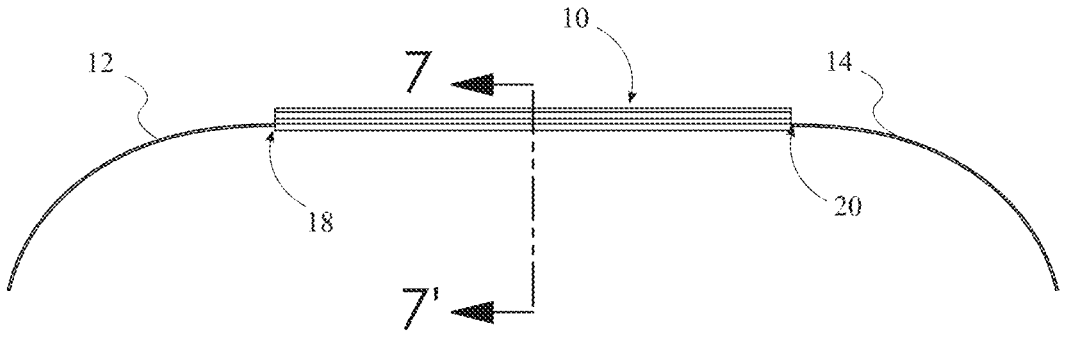
FIG. 6 is a front view of the exemplary embodiment for the present invention.
Figure 7:
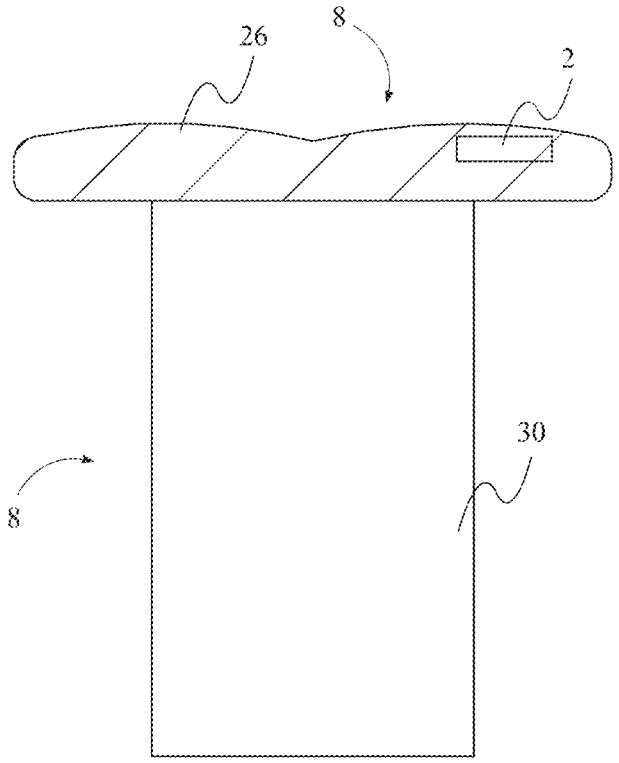
FIG. 7 is a cross-section view taken along line 7-7 in FIG. 6.

A more detailed description of the present invention follows. According to the preferred embodiment, the backpack handle 6 comprises a handle housing 10, a first attachment mechanism 12 and a second attachment mechanism 14. Preferably, the first attachment mechanism 12 and the second attachment mechanism 14 are a plurality of webbing that is designed with a flexible fabric material that has a herringbone thread pattern for flexibility and strength. The plurality of webbing connects the backpack handle 6 to any standard backpack outer surface. Accordingly, the handle housing 10 comprises a first housing end 18 and a second housing end 20, wherein the first housing end 18 is mounted onto the proximal exterior surface 16 by the first attachment mechanism 12, and the second housing end 20 is mounted onto the proximal exterior surface 16 by the second attachment mechanism 14. In other words, the first attachment mechanism 12 and the second attachment mechanism 14 are positioned along the terminal ends of the backpack handle 6 as seen in FIG. 4. Preferably, the first attachment mechanism 12 and the second attachment mechanism 14 are flexible. However, it should be noted that the first attachment mechanism 12 and the second attachment mechanism 14 may comprise any other material, size, shape, etc. as long at the intents of the present invention are not hindered.

As seen in FIG. 1, in the preferred embodiment, the backpack bag 8 comprises a top bag end 38 and a bottom bag end 40. Preferably, the top bag end 38 and the bottom bag end 40 are positioned opposite to each other about the backpack bag 8, and the proximal exterior surface 16 is positioned adjacent to the top bag end 38 of the backpack bag 8.

In reference to FIG. 2, wherein the backpack bag 8 and the backpack handle 6 are arranged into the deployed configuration, the handle housing 10 is positioned offset from the proximal exterior surface 16, and the at least one handle magnet 2 is in weak magnetic communication with the at least one backpack magnet 4. In other words, during the deployed configuration, the handle is not attached to the backpack surface and the user may hold, carry, or lift the backpack with the handle. Further, in reference to FIG. 3, wherein the backpack bag 8 and the backpack handle 6 are arranged into the stowed configuration, the handle housing 10 is pressed against the proximal exterior surface 16, and the at least one handle magnet 2 is in strong magnetic communication with the at least one backpack magnet 4. In other words, during the stowed configuration, the backpack handle 6 is magnetically secured to the plurality of backpack magnets, and the user may secure the backpack handle 6 to the surface of the backpack conveniently. As seen in FIG. 2 and FIG. 3, the at least one handle magnet 2 and the at least one backpack magnet 4 are concealed within the backpack for providing aesthetic appeal.

As seen in FIG. 4 through FIG. 7, the handle housing 10 comprises at least one handle magnet groove 22, a handle fabric 24, and an inner handle layer 26. According to the preferred embodiment, the at least one handle magnet 2 is saddled into position with a nesting-hole in the foam, and then sewn with material to keep the magnets in place. Thus, the at least one handle magnet groove 22 traverses into the inner handle layer 26, and the at least one handle magnet 2 is positioned within the at least one handle magnet groove 22. It should be noted that additional reinforcement methods that are known to one of ordinary skill in the art, such are sewing, fixing with an adhesive, etc. may be utilized for securing the at least one handle magnet 2 within the at least one handle magnet groove 22. Further, the handle fabric 24 encapsulates the inner handle layer 26 and the at least one handle magnet 2. In other words, the handle fabric 24 encompasses the center of the backpack handle 6, in between the attachment mechanism and the second attachment mechanism 14. The handle housing 10 is stitched into the backpack handle 6 to secure the handle housing 10 in place.

Similarly, the proximal exterior surface 16 comprises at least one backpack magnet groove 28, a bag fabric 30, and an inner support layer 32. In the preferred embodiment, the at least one backpack magnet groove 28 traverses into the inner support layer 32, and the at least one backpack magnet 4 is positioned within the at least one backpack magnet groove 28. It should be noted that additional reinforcement methods that are known to one of ordinary skill in the art, such are sewing, fixing with an adhesive, etc. may be utilized for securing the at least one backpack magnet 4 within the at least one backpack magnet groove 28. Preferably, the inner handle layer 26, and the inner support layer 32 are thin layers of foam that provides a bed for placing the backpack magnets within as well as providing a comfortable surface for the backpack user. Furthermore, the bag fabric 30 covers the inner support layer 32 and the at least one backpack magnet 4.

It is an aim of the present invention to enable users to secure the backpack handle 6 onto the backpack surface as per need, with the help of magnetic attraction between the at least one backpack magnet 4 and the at least one handle magnet 2. To accomplish this, a distal magnetic pole 34 of the at least one handle magnet 2 is oriented towards the at least one backpack magnet 4, and a proximal magnetic pole 36 of the at least one backpack magnet 4 is oriented towards the at least one handle magnet 2. Further, the distal magnetic pole of the at least one handle magnet 2 and the proximal magnetic pole 36 of the at least one backpack magnet 4 are of opposite magnetic polarities. This is so that the backpack magnets and the handle magnets attract and form a connection when placed within the appropriate distance. Thus, the present invention is a standard backpack handle with integrated magnets, that helps secure a handle when not in use and without any metal or magnetic parts installed on the outside or the backpack.

Although the invention has been explained in relation to its preferred embodiment, it is to be understood that many other possible modifications and variations can be made without departing from the spirit and scope of the invention as hereinafter claimed.

What is claimed is:

1. A magnetic backpack handle device comprising:

at least one handle magnet;

at least one backpack magnet;

a backpack handle;

a backpack bag;

the backpack handle comprising a handle housing, a first attachment mechanism, and a second attachment mechanism;

the backpack bag comprising a proximal exterior surface and a pair of shoulder straps;

the handle housing comprising a first housing end and a second housing end;

the at least one handle magnet being integrated into the backpack handle;

the proximal exterior surface being a rear padded surface of the backpack bag, adjacent to the pair of shoulder straps;

the at least one backpack magnet being integrated into the backpack bag, adjacent to the proximal exterior surface;

the backpack handle being mounted adjacent to the proximal exterior surface of the backpack bag;

the first housing end being mounted onto the proximal exterior surface by the first attachment mechanism;

the second housing end being mounted onto the proximal exterior surface by the second attachment mechanism;

the first attachment mechanism and the second attachment mechanism being flexible; and the at least one handle magnet being operatively coupled to the at least one backpack magnet, wherein a position of the backpack handle in relation to the proximal exterior surface and a magnetic field of attraction between the at least one backpack magnet and the at least one handle magnet are used to transition the backpack handle from a deployed configuration to a stowed configuration and vice versa.

2. The magnetic backpack handle device of claim 1 further comprising:

the first attachment mechanism being a first fabric webbing sewn onto the proximal exterior surface by a first herringbone threading; and the second attachment mechanism being a second fabric webbing sewn onto the proximal exterior surface by a second herringbone threading.

3. The magnetic backpack handle device of claim 1, wherein, when the backpack bag and the backpack handle are arranged into the deployed configuration, the handle housing is positioned offset from the proximal exterior surface.

4. The magnetic backpack handle device of claim 1, wherein, when the backpack bag and the backpack handle are arranged into the stowed configuration, the handle housing is pressed against the proximal exterior surface, and the at least one handle magnet is in magnetic communication with the at least one backpack magnet.

5. The magnetic backpack handle device of claim 1 further comprising:

the handle housing further comprising at least one handle magnet groove, a handle fabric, and an inner handle layer;

the at least one handle magnet groove traversing into the inner handle layer;

the at least one handle magnet being positioned within the at least one handle magnet groove;

the at least one handle magnet laying flush within the inner handle laver; and the handle fabric encapsulating the inner handle layer and the at least one handle magnet.

6. The magnetic backpack handle device of claim 1 further comprising:

the proximal exterior surface comprising at least one backpack magnet groove, a bag fabric, and an inner support layer;

the at least one backpack magnet groove traversing into the inner support layer;

the at least one backpack magnet being positioned within the at least one backpack magnet groove;

the at least one backpack magnet laying flush within the inner support layer; and the bag fabric covering the inner support layer and the at least one backpack magnet.

7. The magnetic backpack handle device of claim 1 further comprising:

a distal magnetic pole of the at least one handle magnet being oriented towards the at least one backpack magnet;

a proximal magnetic pole of the at least one backpack magnet being oriented towards the at least one handle magnet; and the distal magnetic pole of the at least one handle magnet and the proximal magnetic pole of the at least one backpack magnet being opposite magnetic polarities.

8. The magnetic backpack handle device of claim 1 further comprising:

the backpack bag comprising a top bag end and a bottom bag end;

the top bag end and the bottom bag end being positioned opposite to each other about the backpack bag; and the proximal exterior surface being positioned adjacent to the top bag end of the backpack bag.

9. A magnetic backpack handle device comprising:

at least one handle magnet;

at least one backpack magnet;

a backpack handle;

a backpack bag;

the backpack handle comprising a handle housing, a first attachment mechanism and a second attachment mechanism;

the backpack bag comprising a proximal exterior surface and a pair of shoulder straps;

the handle housing comprising a first housing end, a second housing end, at least one handle magnet groove, a handle fabric, and an inner handle layer;

the proximal exterior surface comprising at least one backpack magnet groove, a bag fabric, and an inner support layer;

the at least one handle magnet being integrated into the backpack handle;

the proximal exterior surface being a rear padded surface of the backpack bag, adjacent to the pair of shoulder straps;

the at least one backpack magnet being integrated into the backpack bag, adjacent to the proximal exterior surface;

the backpack handle being mounted adjacent to the proximal exterior surface of the backpack bag, the first housing end being mounted onto the proximal exterior surface by the first attachment mechanism;

the first attachment mechanism being a first fabric webbing sewn onto the proximal exterior surface by a first herringbone threading;

the second housing end being mounted onto the proximal exterior surface by the second attachment mechanism;

the second attachment mechanism being a second fabric webbing sewn onto the proximal exterior surface by a second herringbone threading;

the first attachment mechanism and the second attachment mechanism being flexible;

the at least one handle magnet being operatively coupled to the at least one backpack magnet, wherein a position of the backpack handle in relation to the proximal exterior surface and a magnetic field of attraction between the at least one backpack magnet and the at least one handle magnet are used to transition the backpack handle from a deployed configuration to a stowed configuration and vice versa;

the at least one handle magnet groove traversing into the inner handle layer;

the at least one handle magnet being positioned within the at least one handle magnet groove;

the at least one handle magnet laying flush within the inner handle layer;

the handle fabric encapsulating the inner handle layer and the at least one handle magnet;

the at least one backpack magnet groove traversing into the inner support layer;

the at least one backpack magnet being positioned within the at least one backpack magnet groove;

the at least one backpack magnet laying flush within the inner support layer; and the bag fabric covering the inner support layer and the at least one backpack magnet.

10. The magnetic backpack handle device of claim 9, wherein, when the backpack bag and the backpack handle are arranged into the deployed configuration, the handle housing is positioned offset from the proximal exterior surface.

11. The magnetic backpack handle device of claim 9, wherein, when the backpack bag and the backpack handle are arranged into the stowed configuration, the handle housing is pressed against the proximal exterior surface, and the at least one handle magnet is in magnetic communication with the at least one backpack magnet.

12. The magnetic backpack handle device of claim 9 further comprising:

a distal magnetic pole of the at least one handle magnet being oriented towards the at least one backpack magnet;

a proximal magnetic pole of the at least one backpack magnet being oriented towards the at least one handle magnet; and the distal magnetic pole of the at least one handle magnet and the proximal magnetic pole of the at least one backpack magnet being opposite magnetic polarities.

13. The magnetic backpack handle device of claim 9 further comprising:

the backpack bag comprising a top bag end and a bottom bag end;

the top bag end and the bottom bag end being positioned opposite to each other about the backpack bag; and the proximal exterior surface being positioned adjacent to the top bag end of the backpack bag.

* * * * *